United States Patent [19]

Andersson et al.

[11] Patent Number: 4,980,025

[45] Date of Patent: Dec. 25, 1990

[54] PAPERMAKING PROCESS

[75] Inventors: Kjell R. Andersson, Billdal; Pavol Barla, Göteborg; Johnny Yrjans, Kungälv, all of Sweden

[73] Assignee: Eka Nobel AB, Surte, Sweden

[21] Appl. No.: 380,737

[22] Filed: Jul. 17, 1989

Related U.S. Application Data

[63] Continuation of Ser. No. 2,677, Jan. 23, 1987, abandoned.

[30] Foreign Application Priority Data

Apr. 3, 1985 [SE] Sweden ..... 8501652

[51] Int. Cl.[5] ..... D21H 17/44; D21H 17/74

[52] U.S. Cl. ..... 162/168.3; 162/181.6; 162/183

[58] Field of Search ..... 162/181.1, 181.4, 181.5, 162/181.6, 168.3, 168.4, 183

[56] References Cited

U.S. PATENT DOCUMENTS

| | | | |
|---|---|---|---|
| 4,294,885 | 10/1981 | Sunden | 162/181.6 |
| 4,309,247 | 1/1982 | Hou et al. | 162/181.6 |
| 4,388,150 | 6/1983 | Sunden et al. | 162/181.6 |
| 4,578,150 | 3/1986 | Hou | 162/181.6 |

FOREIGN PATENT DOCUMENTS

| | | |
|---|---|---|
| 67735 | 1/1985 | Finland . |
| 67736 | 1/1985 | Finland . |
| 8301970 | 6/1983 | PCT Int'l Appl. . |
| 8600100 | 1/1986 | PCT Int'l Appl. . |
| 7900587 | 7/1980 | Sweden . |

*Primary Examiner*—Peter Chin

*Attorney, Agent, or Firm*—Burns, Doane, Swecker & Mathis

[57] ABSTRACT

In a process for making paper from an aqueous paper pulp, especially a pulp containing bleached/unbleached mechanical pulps or unbleached chemical pulps, a combination of chemicals is added for improving drainage and retention. As drainage-and retention-improving aids are added a cationic polyacrylamide and a sol of colloidal inorganic particles having at least one surface layer of aluminium silicate or aluminum-modified silicic acid.

11 Claims, 9 Drawing Sheets

PAPERMAKING PROCESS

Figure 1:
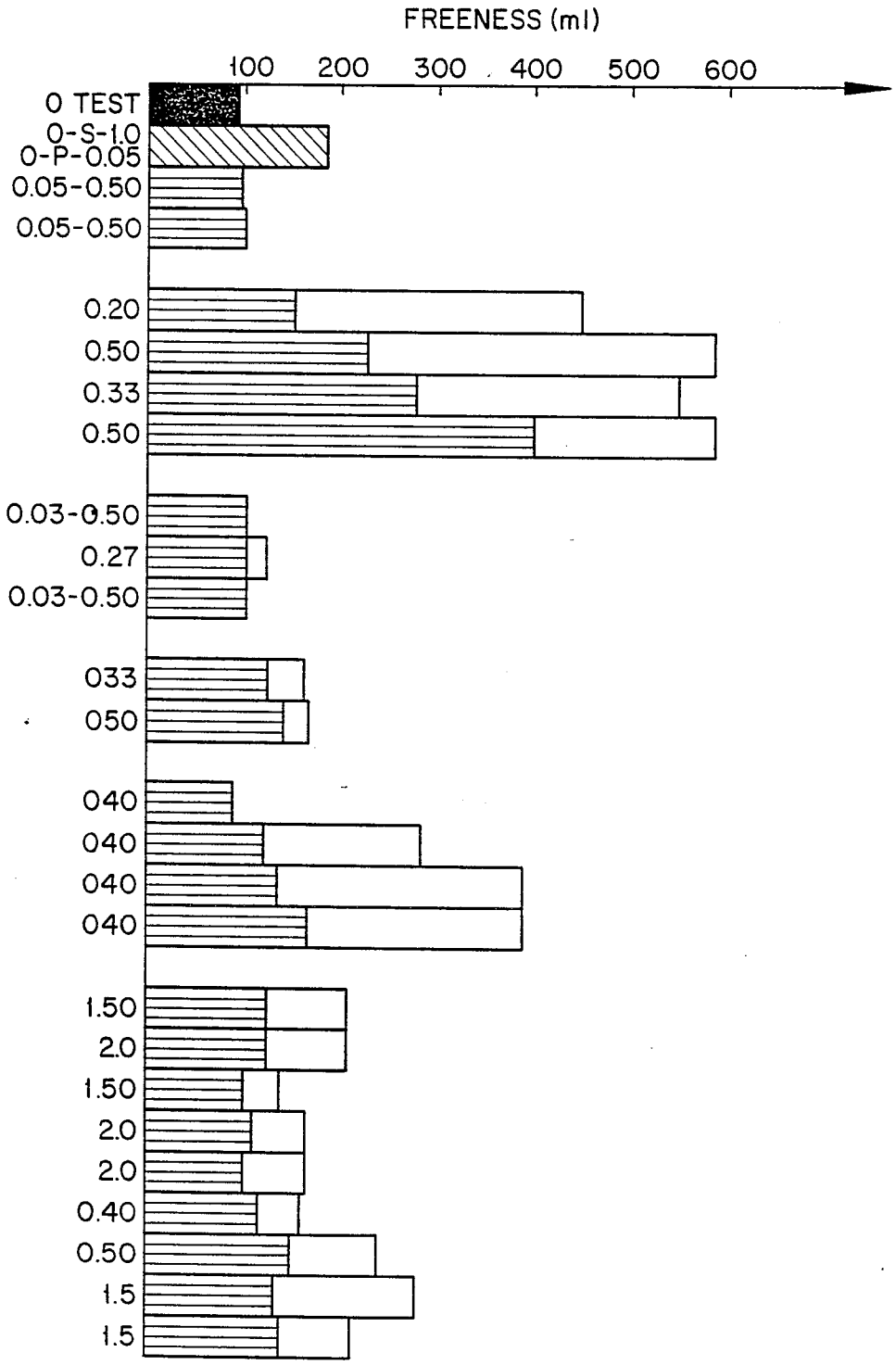
Figure 3:
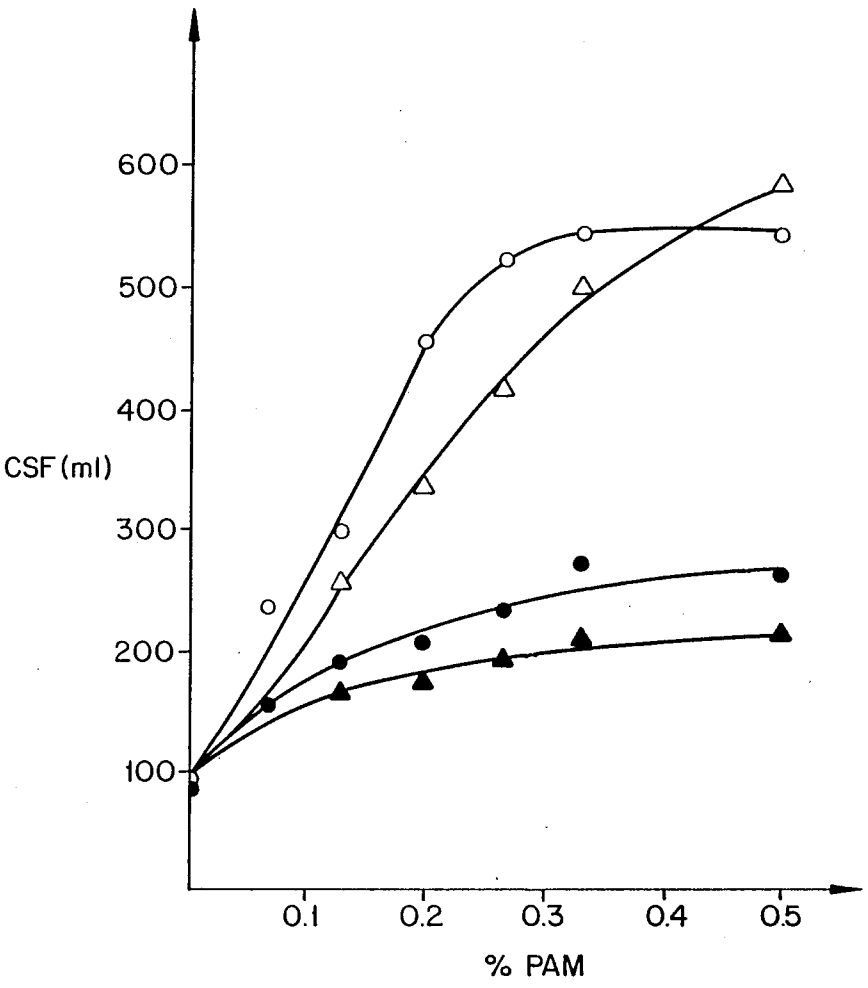

This application is a continuation of application Ser. No. 002,677, filed Jan. 23, 1987 abandoned.

The present invention generally relates to a papermaking process in which an aqueous paper pulp containing cellulosic pulp and, optionally, also mineral filler, is formed and dried, drainage- and retention-improving chemicals being added to the paper pulp prior to forming.

Papermaking processes of this general type are widely disclosed in the literature.

In the making of different grades of paper using bleached/unbleached mechanical pulps or unbleached chemical pulps, drainage and retention problems are normally encountered. This seems to be because when making special paper grades, high contents of detrimental or trash substances are had in the paper stock. These detrimental and trash substances consist of substances dissolved from the fibre, such as kraft lignin, lignosulphonates, hemicellulose, rosin and salts. In order to counteract the drainage and retention problems, it is possible to use various retention aids available on the market, but the effect of these aids is adversely affected by the detrimental or trash substances present in the stock. This is a well-known problem and has been discussed in the literature, for instance in the Swedish Paper Journal (Svensk Papperstidning) No. 14, 1979, pp. 408–413, and the Swedish Paper Journal No. 12, 1982, pp. 100–106. These basic works have shown that there is a reaction between e.g. anionic lignosulphonate and cationic retention aid, and that a so-called polyelectrolyte complex is formed. Such complexes often have an adverse effect on the drainability of the paper stock.

One object of the present invention therefore is to provide a drainage and retention system which counteracts the drainage and retention problems encountered in papermaking, especially in the making of paper products based on bleached/unbleached mechanical pulps or unbleached chemical pulps. Another object of the invention is to provide a papermaking process providing satisfactory drainage and retention also when using such pulps.

Further objects and advantages of the invention will appear from the following specification and the accompanying drawings. FIGS. 1–12 are diagrams of the results obtained in the Examples given below.

The invention is based on the surprising discovery that special cationic polymers, in combination with a special inorganic colloid, will give a substantial improvement in respect of drainage and retention on both mechanical and unbleached chemical pulps.

Quite generally, the system according to the invention comprises the step of admixing in the paper stock prior to forming a special combination of chemicals which comprise two components, one anionic and one cationic component. The anionic component is formed of colloidal particles having at least one surface layer of aluminium silicate or aluminium-modified silicic acid. The cationic component is formed of a cationic polyacrylamide. The characterizing features of the invention are stated in the accompanying claims.

It is previously known to use combinations of anionic and cationic components in connection with papermaking. Thus, European Patent EP-B- No. 0,041,056 discloses a binder system where the fibres of the paper are bonded with the aid of a combination of cationic starch and silicic acid sol.

Another known method for improving the properties of a paper product is disclosed in EP-B- No. 0,080,986 in which a binder system is formed of colloidal silicic acid and cationic or amphoteric guar gum.

In a development not yet published of the binder systems disclosed in the last-mentioned two patent specifications, use is made of a special inorganic sol which is an aluminium silicate sol or an aluminium-modified silicic acid sol (Swedish patent application No. 8403062-6). This special sol has been found to give a particularly notable improvement in the function of the binder. An aluminium oxide-modified silicic acid sol as such has previously been used in connection with papermaking but not in combination with cationic substances. This appears from Swedish patent application No. 7900587-2.

European patent EP-B- No. 0,020,316 discloses a surface-modified pigment having a surface coating in the form of two layers where one layer consists of an $Al_2O_3$—$SiO_2$ hydrate gel and the other layer consists of a polymeric binder. As examples of polymeric binders are stated e.g. polyacrylate and cationic polyamides. This patent specification however relates to a pigment and aims at improving the properties of the pigment as an additive in paper or paints. The patent specification is not concerned with modifying the drainage and retention characteristics of a paper pulp.

Finnish Patents FI-C- No. 67,735 and FI-C- No. 67,736 disclose a three-component system for hydrophobic sizing of paper, which comprises a sizing agent, a cationic polymer and an anionic polymer. Examples of sizing agents are rosin acid, activated rosin acid, alkyl ketene dimer, carbamoyl chloride, succinic anhydride, fatty acid anhydride or fatty acid chloride. Examples of cationic polymers are cationic starch, cationic guar gum, polyacrylamide, polyethylene imine, polyamine or polyamide amine. Examples of anionic polymers are colloidal silicic acid, bentonite, carboxymethyl cellulose or carboxylated polyacrylamide. The Examples stated in the patent specifications use bleached sulphate pulp as fibre material in the stock, for which reason the amount of detrimental or trash substances is small. Nothing is mentioned in the patent specifications about the influence of the trash substances on the papermaking process. A preferred pH range of 6–8 is stated, which is in contradistinction to the present invention yielding good results within the entire pH range and, thus, also on the acid side, which is of importance when using mechanical stocks and other stocks having a high content of detrimental or trash substances.

The known two-component systems based on one anionic and one cationic component thus mainly serve as binders and have yielded good results on most papermaking stocks, for instance an increased bonding strength of the finished paper. Also, it is possible in some cases on e.g. wood-containing printing papers to obtain an increase in strength by means of such systems, especially with the system using guar gum and colloidal silicic acid.

It has however been found that these known systems are not fully effective for solving the drainage and retention problems in all types of papermaking stocks. This is particularly notable in stocks containing bleached/unbleached mechanical or unbleached chemical pulps. As mentioned above, this seems to be because cationic starch and cationic or amphoteric guar gum presumably has a tendency to react by preference with the dissolved wood or trash substances, such that the yield of the desired reaction with the inorganic sol is reduced.

If, as in the invention, the cationic starch or the guar gum is replaced by cationic polyacrylamide and the inorganic colloid is a sol the particles of which have at least one surface layer of aluminium silicate or aluminium-modified silicic acid, as indicated above, there is however obtained a considerably higher reaction selectivity to the anionic inorganic colloid, also at high contents of trash substances, especially dissolved wood substances. As will appear from the following Examples, this improvement is extremely manifest.

The greatest improvements obtained with the invention have been observed when the system is used for mechanical pulps or unbleached chemical pulps. However, improvements are also obtained for other types of pulps, such as chemical pulp, e.g. sulphate or sulphite pulp from both hardwood and softwood. The improvements with thermomechanical and mechanical pulps are highly significant. As used herein, the term "cellulosic pulp" and "cellulosic fibres" refer to all types of paper stocks containing chemical pulp, thermomechanical pulp, chemi-thermomechanical pulp, refiner mechanical pulp and groundwood pulp.

The pulp from which the paper is formed may include mineral fillers of conventional types, such as kaolin, bentonite, titanium dioxide, gypsum, chalk, and talc. As used herein, the term "mineral filler" includes, in addition to these fillers, wollastonite and glass fibres and also mineral low-density fillers, such as expanded perlite. The mineral filler is usually added in the form of an aqueous slurry in the conventional concentrations used for such fillers.

As mentioned above, the mineral fillers in the paper may consist of or comprise a low-density or high-bulk filler. The possibility of adding such fillers to conventional paper stocks is limited by factors such as the drainage of the paper stock on the wire and the retentions of the fillers on the wire. It has been discovered that the problems caused by the addition of such fillers can also be counteracted or substantially eliminated by using the system according to the present invention.

In the drainage and retention system according to the invention, the inorganic colloid should consist of colloidal particles having at least one surface layer of aluminium silicate or aluminium-modified silicic acid, such that the surface groups of the particles contain silicon atoms and aluminium atoms in a ratio of from 9.5:0.5 to 7.5:2.5. The particles of the sol should preferably have a surface area of 50–1000 $m^2/g$ and more preferably about 200–1000 $m^2/g$, the best results having been observed when the surface area has been about 300–700 $m^2/g$. The sol has advantageously been stabilized with an alkali. If the sol consists of an aluminium-modified silicic acid, the stabilization with alkali can be performed with an alkali having a molar ratio of $SiO_2$:$M_2O$ of from 10:1 to 300:1, preferably from 15:1 to 100:1 (M is an ion selected from the group consisting of Na, K, Li and $NH_4$) It has been established that the colloidal sol particles should have a size of less than 20 nm and preferably an average particle size ranging from about 10 down to 1 nm (a colloidal particle of aluminium-modified silicic acid having a surface area of about 550 $m^2/g$ corresponds to an average particle size of about 5.5 nm).

If the colloidal particles consist of a pure aluminium silicate sol, this can be prepared in a known manner by precipitation of water glass with sodium aluminate. Such a sol has homogeneous particles, such that the surfaces of the particles have silicon atoms and aluminium atoms in a ratio of 7.5:2.5. Alternatively, use can be made of an aluminium-modified silicic acid sol, i.e. a sol in which only a surface layer of the surfaces of the sol particles contains both silicon and aluminium atoms. Such an aluminium-modified sol is prepared by modifying the surface of a silicic acid sol with aluminate ions, which is possible presumably because both aluminium and silicon may under suitable conditions assume the coordination number 4 or 6 in relation to oxygen, and because they both have approximately the same atomic diameter. Since the aluminate ion $Al(OH)_4^{-1}$ is geometrically identical with $Si(OH)_4$, the ion can be inserted or substituted into the $SiO_2$ surface, thus generating an aluminium silicate seat having a fixed negative charge. Such an aluminium-modified silicic acid sol is far more stable against gel formation within the pH range 4–6 within which unmodified silicic acid sols may gel quickly, and is less sensitive to salt. The production of aluminium-modified silicic acid sols is well known and disclosed in the literature, for example in the book "The Chemistry of Silica" by Ralph K. Iler, John Wiley & Sons, New York, 1979, pp. 407–410.

The modification of the silicic acid sol thus implies that a given amount of sodium aluminate is caused to react at high pH (about 10) with the colloidal silicic acid. This means that the colloidal $\equiv Al—OH^{-1}$. At low pH (4–6), these groups are strongly aniodic in character. This is in contradistinction to a pure unmodified silicic acid sol where this strong anionic character is not obtained at low pH since silicic acid is a weak acid with $pK_s$ of about 7.

It has been found that the pH of the paper stock in a papermaking process according to the present invention is not particularly critical and may lie in a pH range of 3.5–10. Values higher than pH 10 and lower than pH 3.5 are however unsuitable. If, according to known technique, use is made of unmodified silicic acid as inorganic colloid, good results can be obtained only at high pH values within this interval, while in the present invention where use is made of aluminium silicate sol or aluminium-modified silicic acid sol, a satisfactory result is obtained within the entire pH range. A particular advantage of the present invention thus is that low pH below 7 or 6 can be used.

Other paper chemicals, such as size, alum and the like, can be used, but care must be taken to ensure that the contents of these substances do not become so excessive as to adversely affect the drainage- and retention-improving effects of the system according to the invention.

To achieve the object of the invention, the cationic polyacrylamide is added to the stock in an amount corresponding to 0.005–1.5% by weight, based on the dry substance of the stock. This content range also applies to the inorganic colloid. Lower addition levels do not seem to give any notable improvement, and higher addition levels do not seem to entail such improvement of drainage and retention as would justify the increased costs caused by the raised addition levels.

The invention will be described in more detail hereinbelow in some Examples.

In the Examples described hereinbelow, use was made of the following chemicals:

ORGANOSORB ® is a bentonite clay obtained from Allied Chemicals, Great Britain.

ORGANOPOL ® is an anionic polyacrylamide obtained from Allied Chemicals, Great Britain.

Different starch products

BMB-190, a cationic starch having an N-content of 0.35%, obtained from Raisio AB, Sweden.

BMB-165, a cationic starch having an N-content of 0.2%, obtained from Raisio AB, Sweden.

HKS, a high-cationised starch having an N-content of 1.75%.

SP-190, an amphoteric starch obtained from Raisio AB, Sweden.

SOLVITOSE ® N, a cationic starch having an N-content of 0.2%, obtained from AB Stadex, Malmö, Sweden.

SOLVITOSE ® D9, a cationic starch having an N-content of 0.75%, obtained from AB Stadex, Malmö, Sweden.

Amylopectin

CATO 210, an amylopectin product having an N-content of 0.23%, obtained from Lyckeby-National AB, Sweden.

WAXI MAIZE, an amylopectin product having an N-content of 0.31%, obtained from Laing National, Great Britain.

Polyimine

POLYIMIN SK, obtained from BASF, West Germany.

POLYMIN, SN, obtained from BASF, West Germany.

Guar gum

MEYPROBOND ® 120, an amphoteric guar gum, obtained from Meyhall AB, Switzerland.

MEYPRCID ® 9801, a cationic guar gum product having an N-content of 2%, obtained from Meyhall AG, Switzerland.

GENDRIV ® 158, a cationic guar gum product having an N-content of 1.43%, obtained from Henkel Corporation, Minneapolis, Minn., USA.

GENDRIV ® 162, a cationic guar gum product having an N-content of 1.71%, obtained from Henkel Corporation, Minneapolis, Minn., USA.

Polyacrylamide products

PAM I, a polyacrylamide designated XZ 87431 obtained from Dow Chemical Rheinwerk GmbH, Reinmünster, West Germany and having a cationic activity of 0.22 meq/g and an approximate molecular weight of 5 million.

PAM II, a polyacrylamide designated XZ 87409 obtained from Dow Chemical Rheinwerk GmbH, Reinmünster, West Germany and having a cationic activity of 0.50 meq/g and an approximate molecular weight of 5 million.

PAM III, a polyacrylamide designated XZ 87410 obtained from Dow Chemical Rheinwerk GmbH, Reinmünster, West Germany and having a cationic activity of 0.83 meq/g and an approximate molecular weight of 5 million.

PAM IV, a polyacrylamide designated XZ 87407 obtained from Dow Chemical Rheinwerk GmbH, Reinmünster, West Germany and having a cationic activity of 2.20 meq/g and an approximate molecular weight of 5 million.

Polyethylene oxide

POLYOX COAGULANT, a coagulant obtained from Union Carbide Corporation, USA.

POLYOX WSR 301, a polyethylene oxide product obtained from Union Carbide Corporation, USA.

Other products

BUBOND 60, a low-molecular weight product having high cationic activity and obtained from Buckman Laboratories, USA BUBOND 65, a high-molecular weight product having high cationic activity and obtained from Buckman Laboratories, USA.

BUFLOCK 171, a low-molecular weight product having high cationic activity and obtained from Buckman Laboratories, USA.

EXAMPLE 1

This Example relates to a drainage test using a Canadian Freeness Tester. The paper grade used was supercalendered magazine paper. The stock comprised 76% fibre and 24% filler (C-clay from English China Clay). The fibre fraction of the stock had the following composition:

22% fully bleached pine sulphate pulp
15% dithionite-bleached thermomechanical pulp
35% groundwood pulp
28% broke.

The stock was taken from a commercial magazine papermaking machine and was diluted with white water from the same machine to a stock concentration of 3 g/l. The white water had a specific conductivity of 85 mS/m and a total organic content TOC=270 mg/l. The pH of the stock was adjusted to 5.5 with diluted sodium hydroxide solution. For different chemical dosages, the drainability of the stock was determined according to SCAN-C 21:65 in a Canadian Freeness Tester.

As inorganic sol, use was made of a 15% Al-silicic acid sol having a surface area of about 500 $m^2/g$ and a ratio of $SiO_2$:$Na_2O$ of about 40 and 9% Al atoms on the sol particle surface which gives 0.46% on the total solids substance of the sol.

Tests were carried out with both various polymers alone and various polymers combined with 0.3% inorganic sol, calculated on dry material. In the tests, 1000 ml of stock suspension was placed in a beaker having an agitator driven at a speed of 800 rpm ("Britt-jar"). In the tests with the various polymers alone, the following sequence of steps was used:

1. Addition of drainage and retention polymer to the stock suspension under agitation.
2. Agitation for 45 sec.
3. Drainage.

In tests using a combination of polymer and sol, the following sequence of steps was used:

1. Addition of drainage and retention polymer under agitation.
2. Agitation for 30 sec.
3. Addition of inorganic sol under agitation.
4. Agitation for 15 sec.
5 Drainage.

Table 1 and FIG. 1 show the results of chemical dosage for obtaining maximum drainability, expressed as milliliter CSF. FIG. 1 shows the considerably improved drainability when using a combination of inorganic sol and polyacrylamide (Tests 5–8), and the best prior art systems using cationic starch in combination with inorganic sol (Tests 18, 20, and 22–26), and a combination of inorganic sol and guar gum (Tests 15–17). The detrimental effect of the trash substances dissolved from the thermomechanical pulp and groundwood pulp is manifest in these known systems as compared with the system according to the invention.

Figure 2:
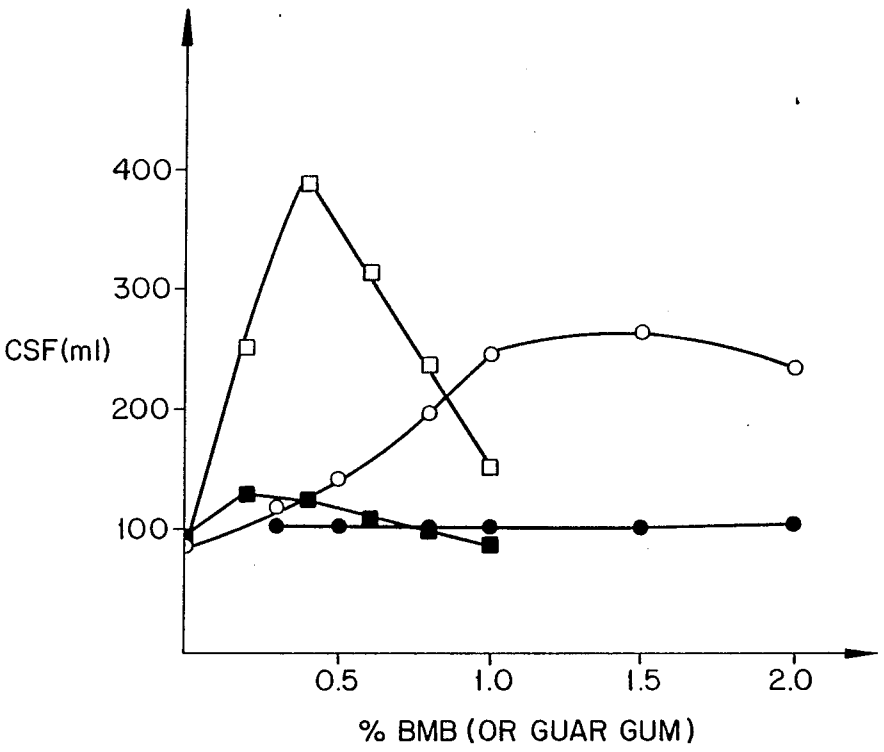
Figure 5:
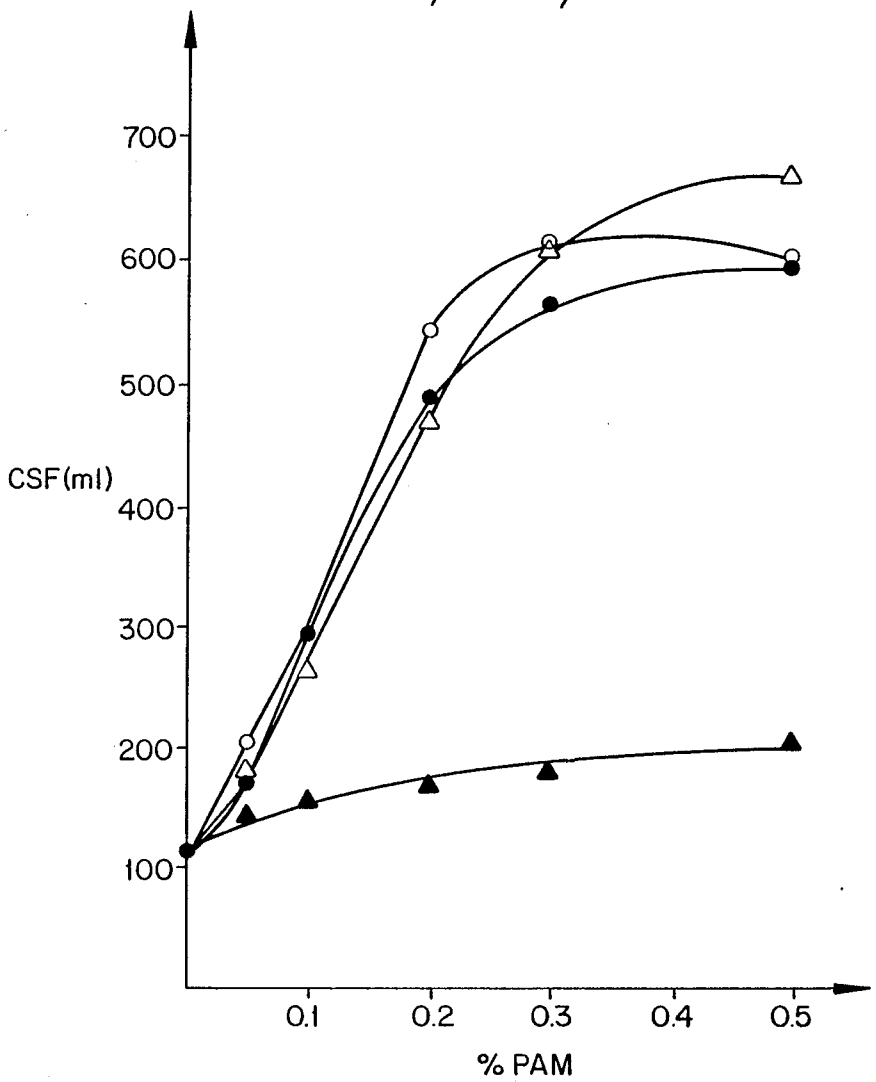
Figure 4:
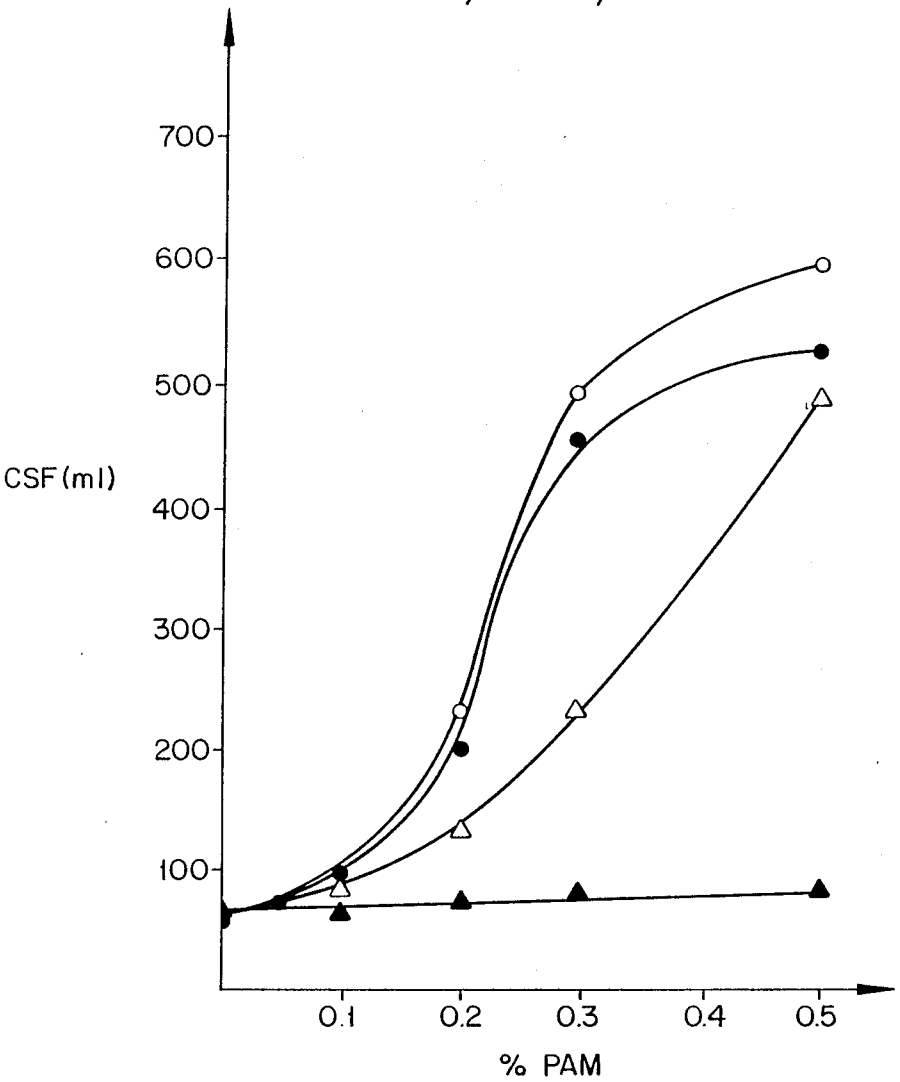
Figure 7:
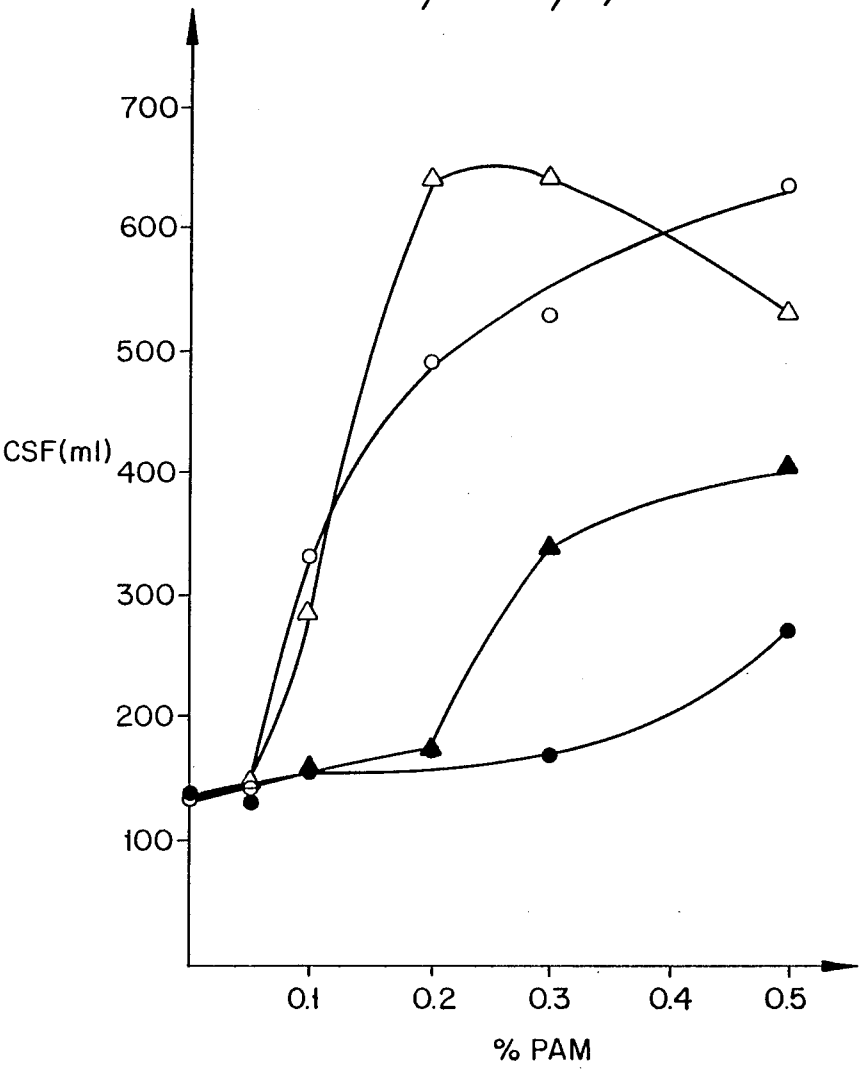
Figure 6:
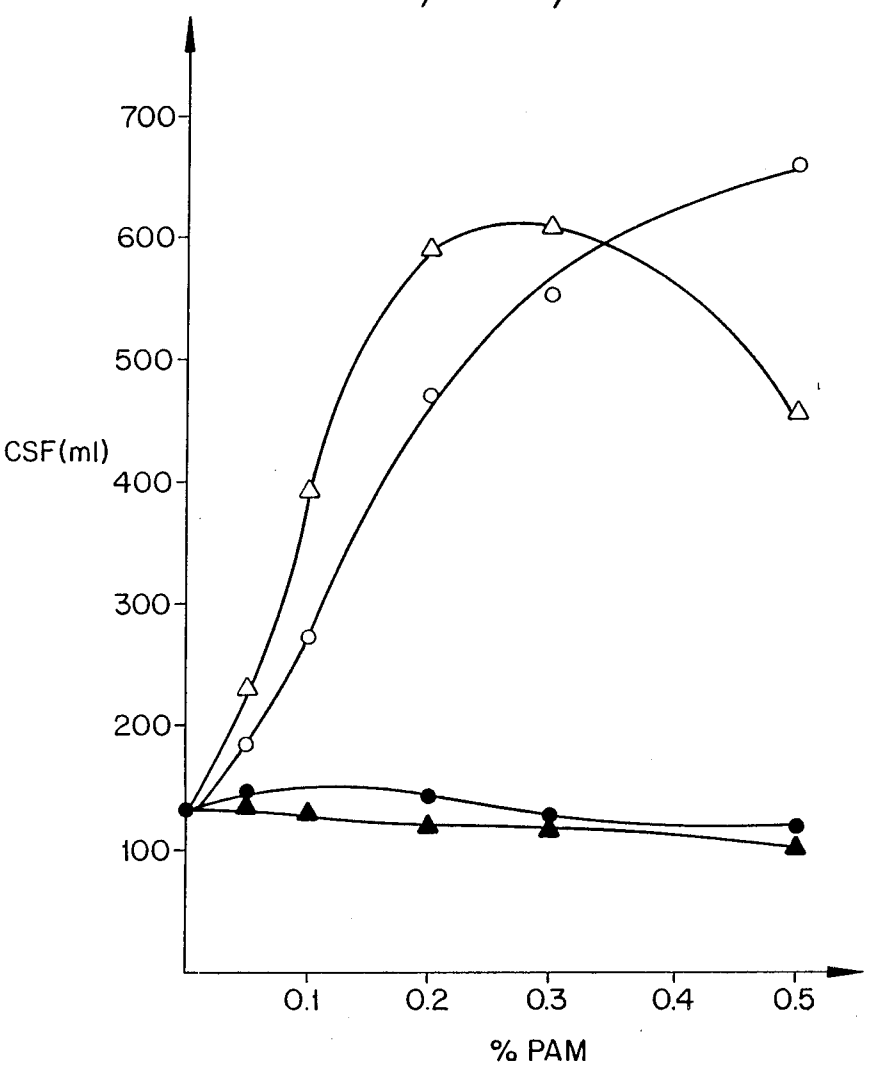

In another series of tests using the same stock, the concentration of inorganic sol was maintained constant at 0.3%, but the added amounts of starch, guar gum or polyacrylamide were varied. The results of these tests are given in Table 2 and illustrated in FIGS. 2 and 3. As appears from Table 2 and FIGS. 2 and 3, drainage was improved in the two known processes and also in the process according to the invention. Thus, FIG. 2 illustrates the improvements obtained with the known technique as disclosed in European patent specification EP-B- No. 0,041,056 (Tests 28–33) and the process as disclosed in European patent specification EP-B- No. 0,080,986 (Tests 34–38). However, when using the system according to the invention (Tests 39–50), the drainability was substantially improved at lower additions of the polyacrylamide.

EXAMPLE 2

This Example relates to a drainage test using mechanical pulps, namely groundwood pulp, chemi-thermomechanical pulp (CTMP), and peroxide-bleached thermomechanical pulp (TMP). The same inorganic sol was used as in Example 1.

Groundwood pulp (spruce) and TMP were taken from two magazine papermaking mills. By centrifugation, the two pulps were concentrated to about 30% dry solids content. The thermomechanical pulp was dried at room temperature to about 90% dry solids content. The chemi-thermomechanical pulp (spruce) was taken in the dry state from a pulp-mill and had a dry solids content of about 95%.

The pulps were placed for a sufficient time in deionized water and thereafter slushed in a wet-slusher (according to SCAN-M2:64). After slushing, the pulp suspensions were diluted to 0.3% (3 g/l) with deionized water. To the resulting stock was added 1.5 g/l $Na_2SO_4.10H_2O$, corresponding to a specific conductivity of about 85 mS/m, such that the specific conductivity was the same as in Example 1, in which white water from a papermaking machine was used.

The pH of the stock suspension was adjusted to 4 or 8 by means of diluted NaOH and $H_2SO_4$ solutions. Drainage tests according to SCAN-C 21:65 were carried out with various PAM products alone and combinations of the various PAM and sol under the same test conditions as in Example 1. The test results are given in Tables 3–7 and FIGS. 4–8.

It clearly appears from these results that a combination of polyacrylamide and inorganic sol gives higher drainage effects that polyacrylamides used alone. The level of the technical effect depends on the pH of the stock, the cationic activity of the polyacrylamide, the chemical character of the pulp, and on the chemical composition of the water phase. In all cases, the improvement obtained by the addition of polyacrylamide is manifest.

Figure 8:
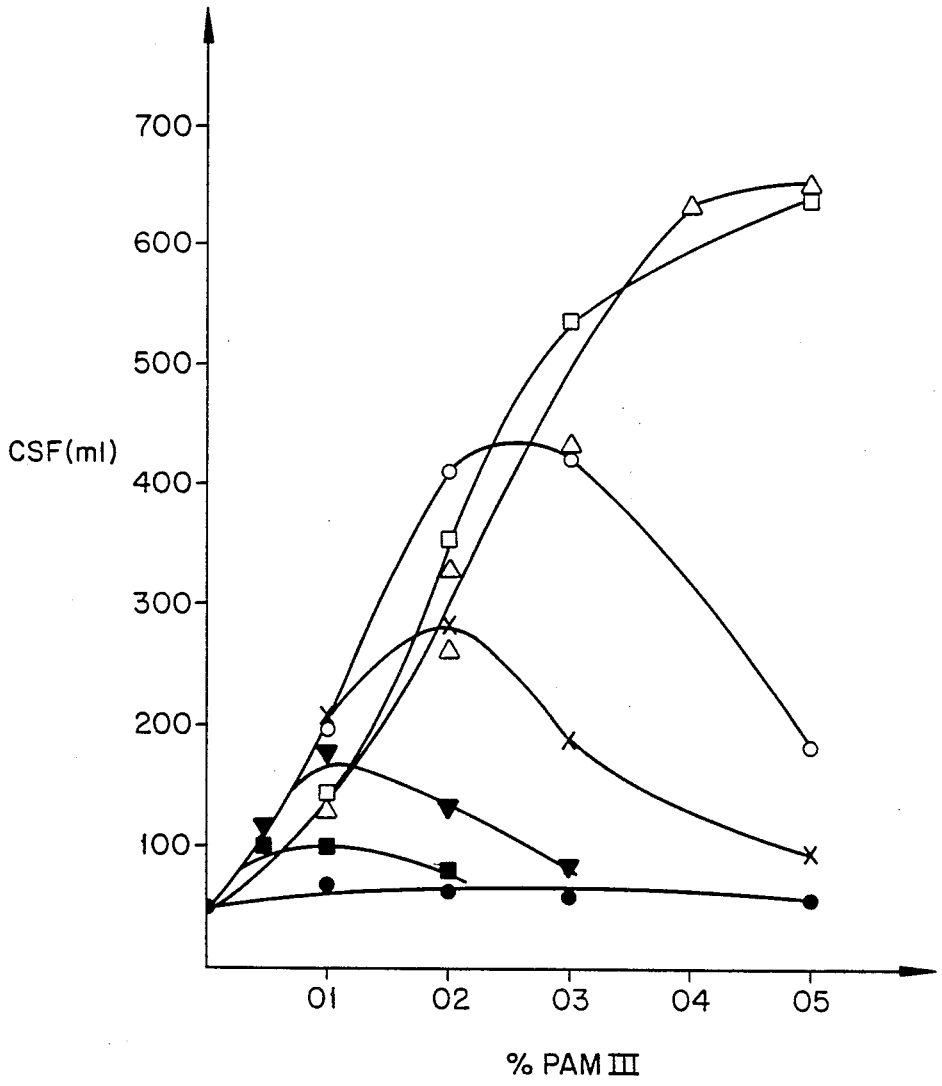

The tests accounted for in Table 7 and FIG. 8 were meant to establish the limit values for the addition of the aluminium-modified silicic acid sol. The concentration of the added sol was thus varied from 0.025% to 1%. With 0.025% sol, an improvement in drainability of about 40–50 ml CSF was obtained as compared with the use of polyacrylamide alone. Such an effect is likely to occur also at lower values for the addition of the sol, but the improvement will not become as notable. The upper limit has been studied at an addition of up to 1% (10 kg/ton of paper), but there is nothing to indicate that the effect would be lost at higher addition levels. A practical upper limit therefore is 1.5% while, for practical reasons, the lower limit is 0.005% for this chemical. The same values apply to the polyacrylamide chemical.

EXAMPLE 3

This Example relates to a drainage test using unbleached sulphate pulp with a kappa number of 53, using a Canadian Freeness Tester according to SCAN-C 21:65. The sol used was the same as in Example 1.

In this test, 360 g dry pulp was placed in 5 liter deionized water for about 20 h. The pulp was thereafter beaten according to SCAN-C 25:76 to a beating degree of about 90 ml CSF. The beating time was about 75 min. The beaten pulp was thereafter diluted with deionized water to a concentration of 3 g/l (0.3%). 1.5 g/l $Na_2SO_4.10H_2O$ was thereafter added to the fibre suspension, and the pH of the fibre suspension was adjusted with diluted NaOH or $H_2SO_4$ to pH 4 or 8.

The other test conditions were the same as in Examples 1 and 2 (order and time for the addition of chemicals, speed and time for agitation).

Figure 9:
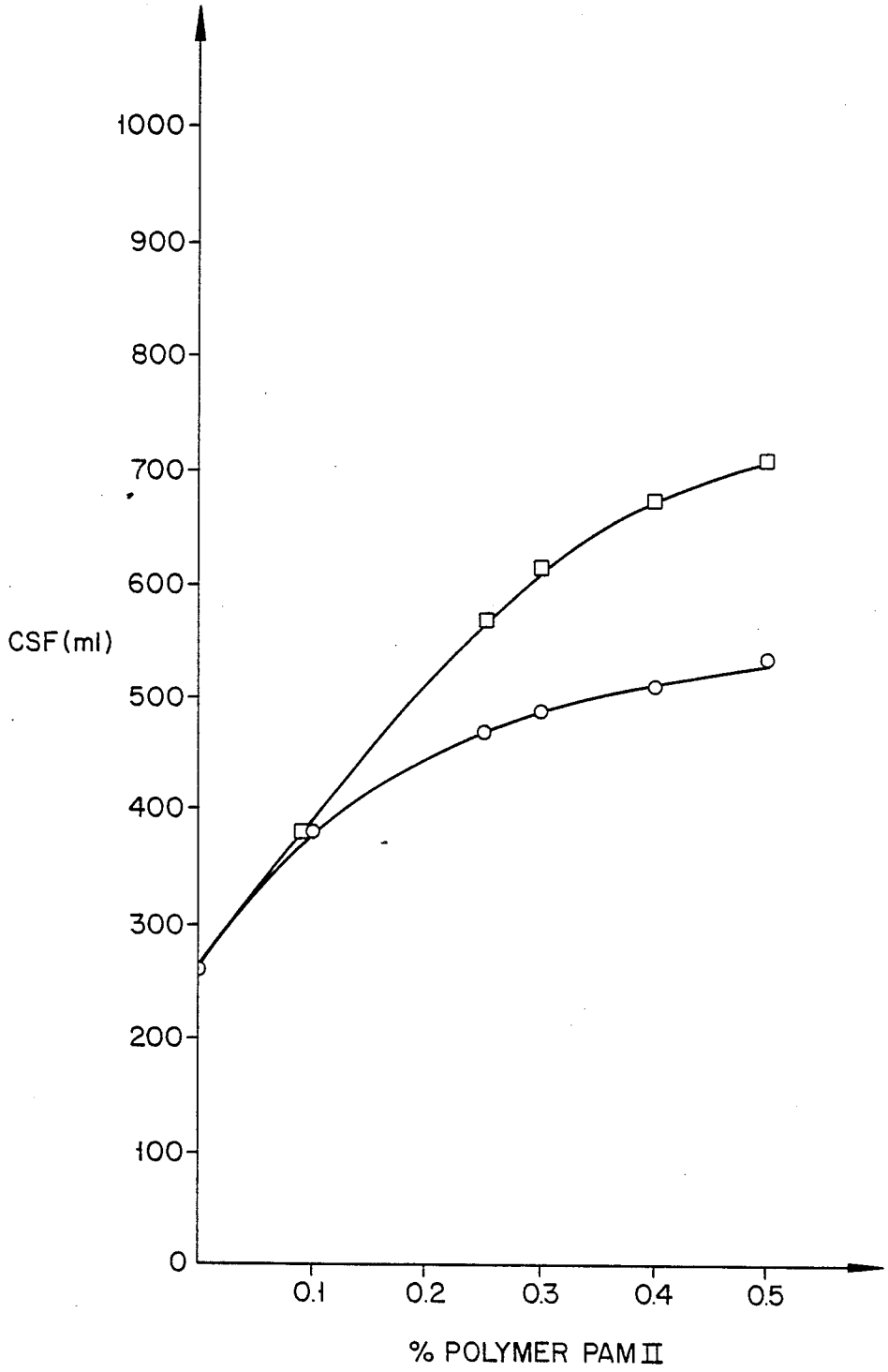
Figure 10:
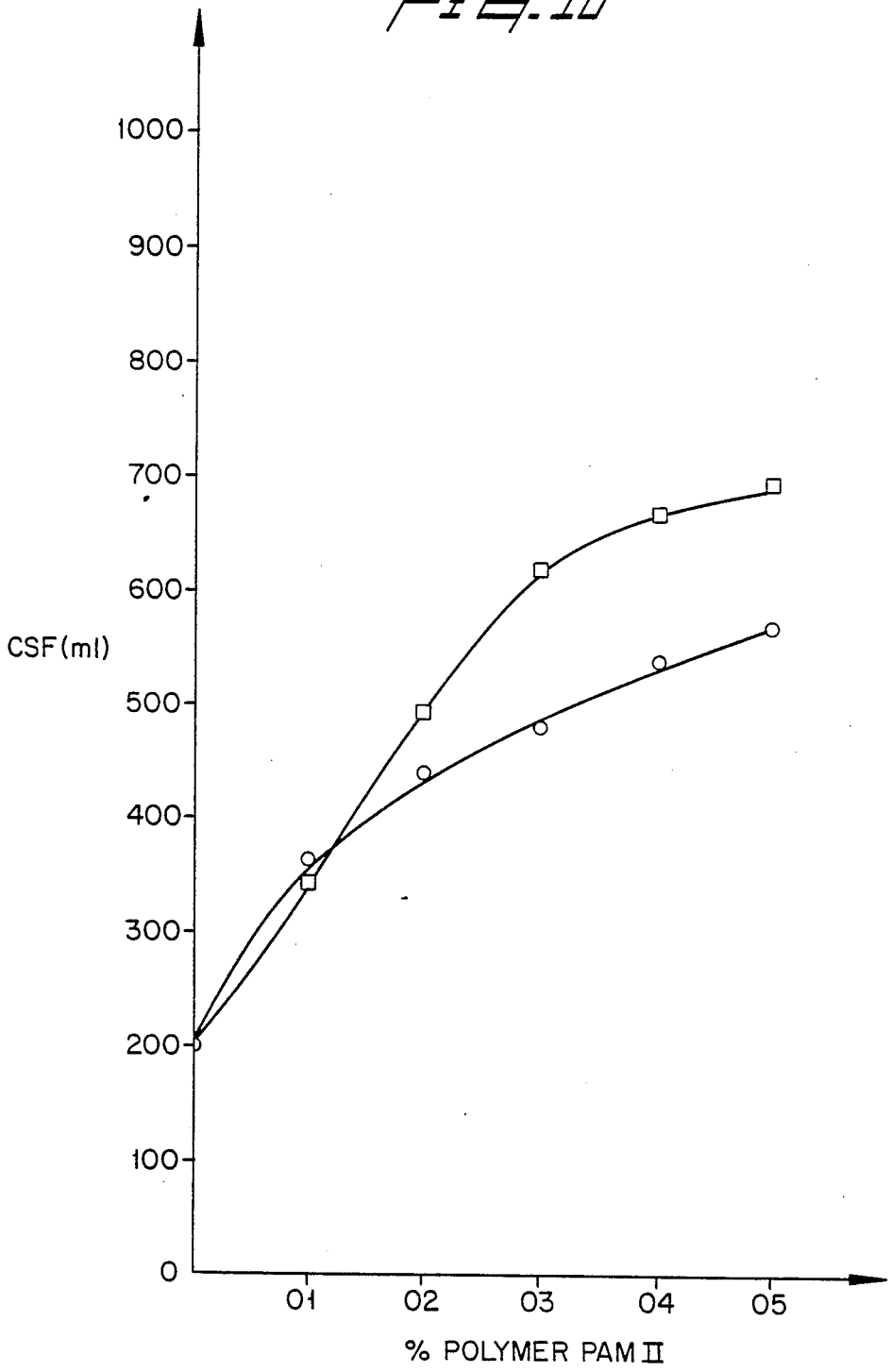

The results are given in Table 8 and also illustrated in FIGS. 9 and 10. The inventive effect clearly appears from these results. The effect is dependent primarily on the pH of the pulp and the chemical composition of the water phase (salt content and presence of dissolved organic substances).

EXAMPLE 4

This Example relates to a drainage test for establishing ash retention. The stock used had the same composition as that in Example 1. In this Example, too, use was made of the same inorganic sol as in Example 1.

For the retention measurements, use was made of a so-called dynamic dewatering jar ("Britt-jar"), the first 100 ml of the filtrate was collected in a measuring glass. In the measurements, use was made of a wire having a mesh size of 76 μm. The chemical dosage method and the agitation technique were the same as in Examples 1–3, and the total time of agitation after chemical dosage was 45 sec. The agitator speed was 800 rpm. The dosage of the colloidal alumium-modified silicic acid sol was carried out 30 sec. after the dosage of the polyacrylamide.

The retention measurement method is described by K. Britt and J. E. Unbehend in Research Report 75, 1/10, 1981, published by Empire State Paper Research Institute ESPRA, Syracuse, N.Y. 13210, USA.

Figure 11:
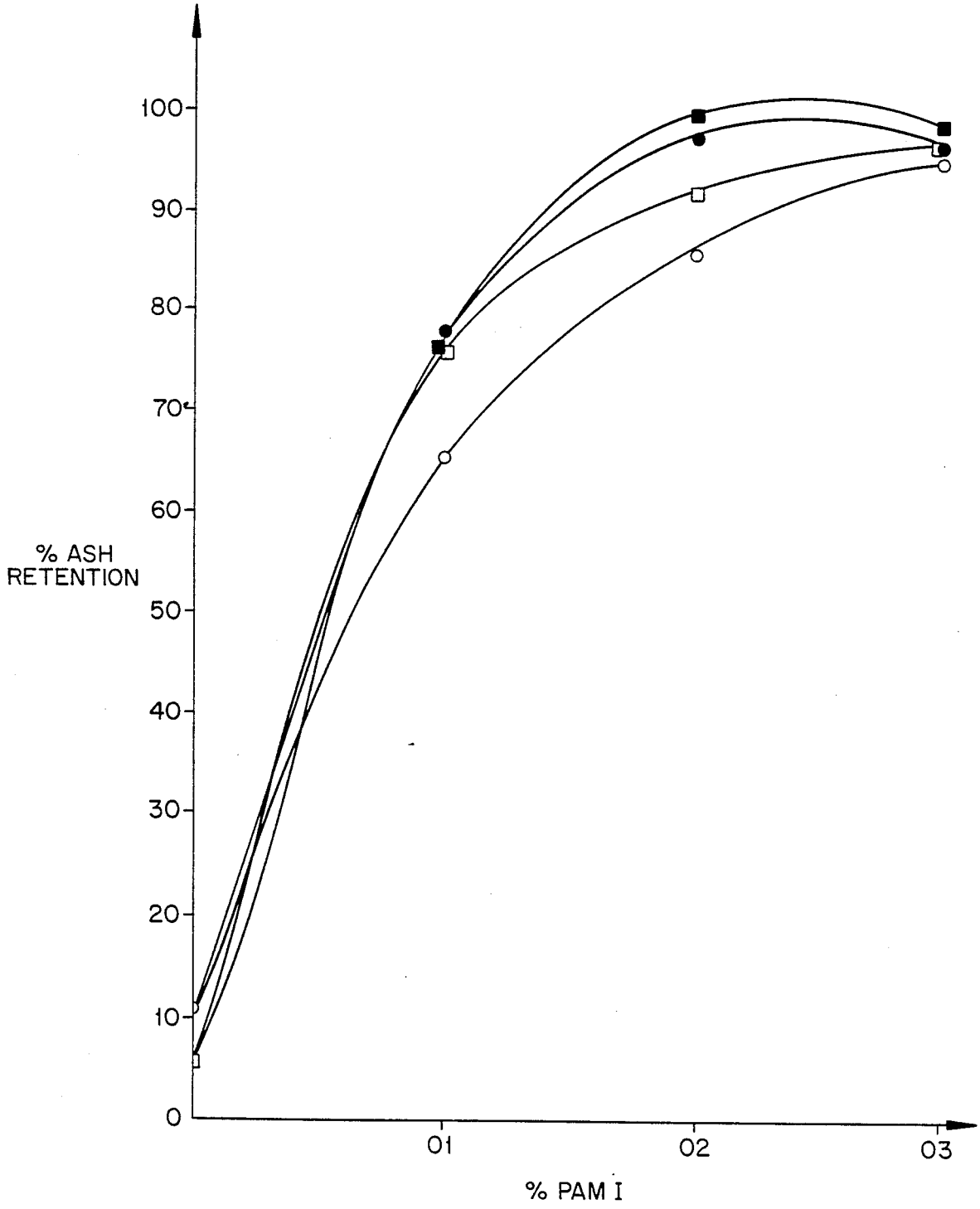
Figure 12:
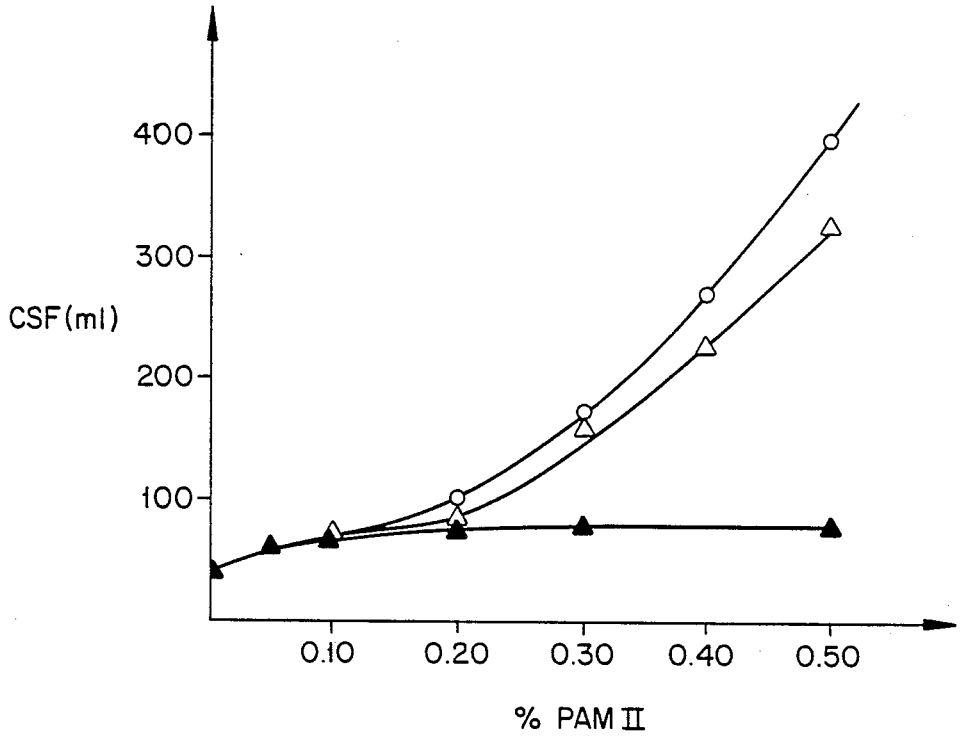

From the results in Table 9 and FIG. 11 it appears that a higher ash retention is obtained with a combination of polyacrylamide and aluminium-modified silicic acid sol than with polyacrylamide alone.

EXAMPLE 5

This Example relates to a drainage test using groundwood pulp. In the test, use was made of two types of sols, namely the same Al-silicic acid sol as in Example 1 and, as a reference, a pure silicic acid sol in the form of a 15% sol having a surface area of about 500 $m^2/g$ and a ratio of $SiO_2:Na_2O$ of about 40.

The groundwood pulp (spruce) was taken from a magazine papermaking mill. By centrifugation, the pulp was concentrated to about 30% dry solids content. After the pulp had been placed for a sufficient time in deionized water, it was beaten in a wet-slusher (according to SCAN-M2:64). After slushing, the pulp suspension was diluted to 0.3% (3 g/l) with deionized water. To the thus obtained stock was added 1.5 g/l $Na_2SO_4.10H_2O$, corresonding to a specific conductivity of about 85 mS/m, such that the specific conductivity was the same as in Example 1, in which white water from a papermaking machine was used.

The pH value of the stock suspension was adjusted to 8 with a diluted NaOH solution. Drainage tests according to SCAN-C21:65 were carried out using PAM alone and combinations of PAM and unmodified silicic acid sol or PAM and aluminium-modified silicic acid sol, under the same test conditions as in Example 1. The test results are given in Table 10 and FIG. 12.

It clearly appears from these results that a combination of polyacrylamide and inorganic sol gives improved drainability as compared with polyacrylamide alone and that the aluminium-modified sol gives a markedly improved result as compared with the unmodified pure silicic acid sol.

EXAMPLE 6

In addition to the above-mentioned tests, a comparison was made between drainage tests using extremely high addition levels of polyacrylamide (PAM III) and the same inorganic sol as in Example 1, and at extreme pH values. These drainage tests were conducted in the manner described in Example 1, both on the stock suspension of groundwood pulp described in Example 5 and on a chemical pulp (bleached sulphate). The results are given in Tables 11 and 12.

TABLE 1

| Chemical dosage for maximum CSF | | | | |
|---|---|---|---|---|
| | | | CSF (ml) | |
| Test No | Chemical | Content % | without sol | with 0.3% sol |
| 1 | Zero test | — | 90 | — |
| 2 | ORGANOSORB + | 1.0 | 170 | — |
| | ORGANOPOL | 0.05 | | |
| 3 | POLYOX-Coagulant | 0.05–0.50 | 97 | — |
| 4 | POLYOX-WSR 301 | 0.05–0.50 | 98 | — |
| 5 | PAM-I | 0.20 | 150 | 450 |
| 6 | PAM-II | 0.50 | 220 | 595 |
| 7 | PAM-III | 0.33 | 280 | 555 |
| 8 | PAM-IV | 0.50 | 405 | 595 |

TABLE 1-continued

| Chemical dosage for maximum CSF | | | | |
|---|---|---|---|---|
| | | | CSF (ml) | |
| Test No | Chemical | Content % | without sol | with 0.3% sol |
| 9 | BUFLOC-171 | 0.03–0.50 | 95 | — |
| 10 | BUBOND-65 | 0.27 | 100 | — |
| 11 | BUBOND-60 | 0.03–0.50 | 100 | — |
| 12 | POLYMIN-SK | 0.33 | 120 | 155 |
| 13 | POLYMIN-SN | 0.50 | 135 | 160 |
| 14 | MEYPROBOND-120 | 0.40 | 85 | — |
| 15 | GENDRIV-158 | 0.4 | 115 | 277 |
| 16 | GENDRIV-162 | 0.4 | 125 | 385 |
| 17 | MEYPROBOND-9801 | 0.4 | 160 | 385 |
| 18 | WM-International Laing | 1.5 | 115 | 200 |
| 19 | WAXI-MAIZE | 2.0 | 115 | 200 |
| 20 | SOLVITOSE-N | 1.5 | 95 | 135 |
| 21 | CATO-210 | 2.0 | 105 | 155 |
| 22 | RAISIO-SP 190 | 2.0 | 95 | 155 |
| 23 | HKS | 0.4 | 110 | 150 |
| 24 | SOLVITOSE-D9 | 0.5 | 140 | 230 |
| 25 | BMB-190 | 1.5 | 115 | 270 |
| 26 | BMB-165 | 1.5 | 130 | 200 |

TABLE 2

| Drainability as a function of added amount of polymer at constant content of inorganic sol (0.3%) | | | | | | |
|---|---|---|---|---|---|---|
| | | | | | CSF (ml) | |
| Test No. | BMB-190 % | GEN-DRIV 162 % | PAM-II % | PAM-III % | without sol | with sol |
| 27 | — | — | — | — | — | 90 |
| 28 | 0.3 | — | — | — | 105 | 120 |
| 29 | 0.5 | — | — | — | 105 | 145 |
| 30 | 0.8 | — | — | — | 110 | 200 |
| 31 | 1.0 | — | — | — | 110 | 250 |
| 32 | 1.5 | — | — | — | 115 | 270 |
| 33 | 2.0 | — | — | — | 120 | 245 |
| 34 | — | 0.2 | — | — | 130 | 250 |
| 35 | — | 0.4 | — | — | 125 | 385 |
| 36 | — | 0.6 | — | — | 110 | 315 |
| 37 | — | 0.8 | — | — | 100 | 240 |
| 38 | — | 1.0 | — | — | 90 | 160 |
| 39 | — | — | 0.067 | — | 145 | 165 |
| 40 | — | — | 0.133 | — | 170 | 260 |
| 41 | — | — | 0.20 | — | 180 | 340 |
| 42 | — | — | 0.267 | — | 200 | 425 |
| 43 | — | — | 0.333 | — | 220 | 510 |
| 44 | — | — | 0.50 | — | 220 | 595 |
| 45 | — | — | — | 0.067 | 160 | 240 |
| 46 | — | — | — | 0.133 | 195 | 305 |
| 47 | — | — | — | 0.20 | 210 | 465 |
| 48 | — | — | — | 0.267 | 240 | 535 |
| 49 | — | — | — | 0.333 | 280 | 555 |
| 50 | | — | — | 0.50 | 270 | 550 |

TABLE 3

| DRAINAGE TESTS WITH CANADIAN FREENESS TESTER | | | | | | | | | | | | | | |
|---|---|---|---|---|---|---|---|---|---|---|---|---|---|---|
| GROUNDWOOD PULP (100%) | | | | | | | | CHEMICAL PULP (100%) | | | | | | |
| PAM I % | Sol % | CSF (pH = 4) | CSF (pH = 8) | PAM IV % | Sol % | CSF (pH = 4) | CSF (pH = 8) | PAM I % | Sol % | CSF (pH = 4) | CSF (pH = 8) | PAM IV % | Sol % | CSF (pH = 4) |
| — | — | 45 | 45 | — | — | 45 | 50 | — | — | 225 | 225 | — | — | 230 |
| | | | | | | | | | | | | 0.025 | — | 240 |
| | | | | | | | | 0.05 | — | 235 | 250 | 0.05 | — | 230 |
| 0.1 | — | 42 | 40 | 0.1 | — | 73 | 110 | 0.10 | — | 250 | 265 | 0.1 | — | 230 |
| 0.2 | — | 40 | 40 | 0.2 | — | 73 | 225 | 0.20 | — | 240 | 245 | 0.2 | — | 235 |
| 0.3 | — | 45 | 35 | 0.3 | — | 65 | 215 | 0.30 | — | 230 | 225 | 0.3 | — | 245 |
| 0.5 | — | 40 | 30 | 0.5 | — | 58 | 210 | 0.50 | — | 230 | — | — | — | — |
| | | | | | | | | 0.025 | 0.3 | 315 | 290 | 0.025 | 0.3 | 270 |
| | | | | 0.05 | 0.3 | 120 | — | 0.05 | 0.3 | 435 | 415 | 0.05 | 0.3 | 410 |
| 0.1 | 0.3 | 100 | 100 | 0.1 | 0.3 | 275 | 157 | 0.10 | 0.3 | 555 | 565 | 0.10 | 0.3 | 625 |
| 0.2 | 0.3 | 263 | 180 | 0.2 | 0.3 | 460 | 405 | 0.20 | 0.3 | 685 | 660 | 0.20 | 0.3 | 635 |
| 0.3 | 0.3 | 260 | 300 | 0.3 | 0.3 | 380 | 415 | 0.30 | 0.3 | 700 | 680 | 0.30 | 0.3 | 460 |
| 0.5 | 0.3 | 265 | 435 | 0.5 | 0.3 | 120 | 385 | | | | | | | |

TABLE 3-continued

| DRAINAGE TESTS WITH CANADIAN FREENESS TESTER | | | | | | | | | | | | | | |
|---|---|---|---|---|---|---|---|---|---|---|---|---|---|---|
| GROUNDWOOD PULP (100%) | | | | | | | | CHEMICAL PULP (100%) | | | | | | |
| PAM I % | Sol % | CSF (pH = 4) | CSF (pH = 8) | PAM IV % | Sol % | CSF (pH = 4) | CSF (pH = 8) | PAM I % | Sol % | CSF (pH = 4) | CSF (pH = 8) | PAM IV % | Sol % | CSF (pH = 4) |
| 1.0 | 0.3 | 168 | — | — | — | — | — | | | | | | | |

TABLE 4

| PEROXIDE-BLEACHED TMP PULP CSF = 54 specific conductivity = 85 mS/m | | | | | |
|---|---|---|---|---|---|
| PAM II % | Sol % | CSF (pH = 4) | PAM IV % | Sol % | CSF (pH = 8) |
| — | — | 63 | — | — | 57 |
| 0.05 | — | 67 | 0.05 | — | 67 |
| 0.10 | — | 63 | 0.10 | — | 93 |
| 0.20 | — | 73 | 0.20 | — | 202 |
| 0.30 | — | 81 | 0.30 | — | 455 |
| 0.50 | — | 86 | 0.50 | — | 532 |
| 0.05 | 0.3 | 72 | 0.05 | 0.3 | 67 |
| 0.10 | 0.3 | 81 | 0.10 | 0.3 | 91 |
| 0.20 | 0.3 | 135 | 0.20 | 0.3 | 230 |
| 0.30 | 0.3 | 237 | 0.30 | 0.3 | 490 |
| 0.50 | 0.3 | 492 | 0.50 | 0.3 | 600 |

TABLE 5

| CTMP pulp CSF = 106, specific conductivity 85 mS/m | | | | | |
|---|---|---|---|---|---|
| PAM II % | Sol % | CSF (pH = 4) | PAM IV % | Sol % | CSF (pH = 8) |
| — | — | 115 | — | — | 113 |
| 0.05 | — | 145 | 0.05 | — | 177 |
| 0.10 | — | 155 | 0.10 | — | 295 |
| 0.20 | — | 170 | 0.20 | — | 490 |
| 0.30 | — | 180 | 0.30 | — | 565 |
| 0.50 | — | 203 | 0.50 | — | 595 |
| 0.05 | 0.3 | 182 | 0.05 | 0.3 | 206 |
| 0.10 | 0.3 | 265 | 0.10 | 0.3 | 295 |
| 0.20 | 0.3 | 472 | 0.20 | 0.3 | 545 |
| 0.30 | 0.3 | 607 | 0.30 | 0.3 | 615 |
| 0.50 | 0.3 | 670 | 0.50 | 0.3 | 605 |

TABLE 6

| DRAINAGE TESTS WITH CANADIAN FREENESS TESTER CHEMICAL PULP/GROUNDWOOD PULP = 50/50, specific conductivity = 85 mS/m | | | | | | | |
|---|---|---|---|---|---|---|---|
| PAM II % | Sol % | CSF (pH = 4) | CSF (pH = 8) | PAM III % | Sol % | CSF (pH = 4) | CSF (pH = 8) |
| — | — | 130 | 135 | — | — | 130 | 135 |
| 0.05 | — | 145 | 130 | 0.05 | — | 135 | 150 |
| 0.10 | — | 155 | 160 | 0.10 | — | 130 | 165 |
| 0.20 | — | 145 | 175 | 0.20 | — | 120 | 180 |
| 0.30 | — | 130 | 175 | 0.30 | — | 125 | 345 |
| 0.50 | — | 130 | 280 | 0.50 | — | 110 | 415 |
| 0.05 | 0.3 | 185 | 145 | 0.05 | 0.3 | 235 | 170 |
| 0.10 | 0.3 | 275 | 335 | 0.10 | 0.3 | 395 | 285 |
| 0.20 | 0.3 | 475 | 395 | 0.20 | 0.3 | 595 | 640 |
| 0.30 | 0.3 | 560 | 535 | 0.30 | 0.3 | 615 | 645 |
| 0.50 | 0.3 | 670 | 645 | 0.50 | 0.3 | 465 | 540 |

TABLE 7

| PAM III % | Sol % | CSF | Sol % | CSF | Sol % | CSF | Sol % | CSF | Sol % | CSF | Sol % | CSF | Sol % | CSF |
|---|---|---|---|---|---|---|---|---|---|---|---|---|---|---|
| 0 | 0 | 50 | 0.025 | — | 0.05 | — | 0.10 | — | 0.20 | — | 0.50 | — | 1.0 | — |
| 0.025 | — | — | 0.025 | 62 | — | — | — | — | — | — | — | — | — | — |
| 0.05 | — | — | 0.025 | 100 | 0.05 | 110 | 0.10 | 110 | — | — | — | — | — | — |
| 0.10 | — | 70 | 0.025 | 95 | 0.05 | 170 | 0.10 | 220 | 0.2 | 195 | 0.50 | 140 | 1.0 | 130 |
| 0.20 | — | 60 | 0.025 | 80 | 0.05 | 125 | 0.10 | 280 | 0.2 | 410 | 0.50 | 350 | 1.0 | 330 |
| 0.30 | — | 55 | — | — | 0.05 | 80 | 0.10 | 185 | 0.2 | 420 | 0.50 | 530 | 1.0 | 430 |
| 0.40 | — | — | — | — | | | — | — | — | — | — | — | 1.0 | 630 |
| 0.5 | — | 45 | — | — | | | 0.10 | 85 | 0.2 | 175 | 0.50 | 630 | 1.0 | 640 |

TABLE 8

| PAM II % | Sol % | CSF (pH = 4) | PAM II % | Sol % | CSF (pH = 8) |
|---|---|---|---|---|---|
| — | — | 265 | — | — | 200 |
| 0.10 | — | 370 | 0.10 | — | 360 |
| 0.25 | — | 465 | 0.20 | — | 435 |
| 0.30 | — | 480 | 0.30 | — | 475 |
| 0.40 | — | 505 | 0.40 | — | 530 |
| 0.50 | — | 530 | 0.50 | — | 560 |
| 0.09 | 0.3 | 375 | 0.10 | 0.3 | 340 |
| 0.25 | 0.3 | 570 | 0.20 | 0.3 | 485 |
| 0.30 | 0.3 | 610 | 0.30 | 0.3 | 610 |
| 0.40 | 0.3 | 660 | 0.40 | 0.3 | 660 |
| 0.50 | 0.3 | 695 | 0 50 | 0.3 | 685 |

TABLE 9

| | Ash retention %, pH-4 | | Ash retention %, pH = 5.5 | |
|---|---|---|---|---|
| PAM I % | without sol | with 0.3% sol | without sol | with 0.3% sol |
| 0 | 11 | — | 6 | — |
| 0.1 | 65 | 77.5 | 75.5 | 76 |
| 0.2 | 85 | 96.5 | 90.5 | 98 |
| 0.3 | 94 | 95 | 95 | 97 |

TABLE 10

| PAM II % | $SiO_2$ sol % | Al-modified $SiO_2$ sol % | CSF (ml) |
|---|---|---|---|
| — | — | — | 40 |
| 0.05 | — | — | 65 |
| 0.10 | — | — | 65 |

TABLE 10-continued

| PAM II % | $SiO_2$ sol % | Al-modified $SiO_2$ sol % | CSF (ml) |
|---|---|---|---|
| 0.20 | — | — | 70 |
| 0.30 | — | — | 75 |
| 0.40 | — | — | — |
| 0.50 | — | — | 75 |
| 0.05 | 0.3 | — | 55 |
| 0.10 | 0.3 | — | 70 |
| 0.20 | 0.3 | — | 65 |
| 0.30 | 0.3 | — | 160 |
| 0.4 | 0.3 | — | 225 |
| 0.5 | 0.3 | — | 325 |
| 0.05 | — | 0.3 | 55 |
| 0.10 | — | 0.3 | 65 |
| 0.20 | — | 0.3 | 105 |
| 0.30 | — | 0.3 | 170 |
| 0.4 | — | 0.3 | 270 |
| 0.5 | — | 0.3 | 400 |

TABLE 11

| Groundwood pulp (100%) pH = 4.0. Specific conductivity = 85 mS/m | | |
|---|---|---|
| PAM III % | Al-modified $SiO_2$ sol % | CSF ml |
| — | — | 40–50 |
| 1.0 | 1.0 | 470 |
| 1.0 | 1.5 | 700 |
| 1.5 | 1.5 | 610 |

TABLE 12

| Chemical pulp (100%). Specific conductivity = 85 mS/m | | | |
|---|---|---|---|
| PAM III % | Al-modified $SiO_2$ sol % | CSF | pH |
| — | — | 100 | — |
| 0.2 | 0.3 | 545 | 3.0 |
| 0.2 | 0.3 | 550 | 10 |

What is claimed:

1. A paper making process comprising forming and drying of an aqueous paper pulp containing sufficient cellulosic fiber to give a finished paper containing at least about 50% cellulosic fiber wherein anionic and cationic components are each separately added to the aqueous paper pulp prior to forming the paper in an amount of at least 0.005% by weight based on the dry paper stock, said cationic component comprising a cationic polyacrylamide and said anionic component being added as a sol comprising anionic colloidal particles having a size less than 20 nm and having at least a surface layer of aluminum silicate or aluminum-modified silicic acid containing silicon atoms and aluminum atoms in a ratio of from 9.5:0.5 to 7.5:2.5.

2. The process according to claim 1 wherein the paper pulp comprises mechanical or unbleached chemical pulp.

3. The process according to claim 1 wherein the anionic colloidal particles comprise aluminum-modified silicic acid.

4. The process as claimed in claim 1 or 3, wherein the cationic polyacrylamide is added in an amount of 0.005–1.5% by weight, calculated on dry paper stock.

5. The process as claimed in claim 1 or 3, wherein said sol is added is an amount of 0.005–1.5% by weight, calculated on dry paper stock.

6. The process as claimed in claim 1 or 3, wherein the pH of the paper pulp is adjusted to from about 3.5 to about $^{3}10$.

7. The process as claimed in claim 1 or 3, wherein said colloidal anionic particles have a surface area of from about 300 to about 700 $m^2/g$.

8. A paper product comprising cellulosic fibers in an amount of at least 50% by weight based on the paper product, an anionic component and a cationic component which are each present in an amount of 0.005% by weight based on the dry soilds content of the paper wherein the cationic component comprises a cationic polyacrylamide, and the anionic component comprises colloidal anionic inorganic particles having a size less than 20 nm and having at least a surface layer of aluminum silicate or aluminum-modified silicic acid containing silicon atoms and aluminum atoms in a ratio of from 9.5:0.5 to 7.5:2.5.

9. A paper product according to claim 8 wherein the anionic particles comprise aluminum-modified silicic acid.

10. Paper product as claimed in claim 8 or 9, wherein the cationic polyacrylamide and the colloidal anionic inorganic particles are each present in an amount of 0.005–1.5% by weight, calculated on the dry solids content of the paper.

11. Paper product as claimed in claim 8 or 9 wherein said colloidal anionic particles have a surface area of from about 300 to about 700 $m^2/g$.

* * * * *

UNITED STATES PATENT AND TRADEMARK OFFICE

CERTIFICATE OF CORRECTION

PATENT NO. : 4,980,025

DATED : December 25, 1990

INVENTOR(S) : KJELL RUNE ANDERSSON et al

It is certified that error appears in the above-identified patent and that said Letters Patent is hereby corrected as shown below:

COLUMN 14;

Claim 8, line 4, "at least" should be inserted between "of" and "0.005%".

Signed and Sealed this

Fourth Day of August, 1992

*Attest:*

DOUGLAS B. COMER

*Attesting Officer*

*Acting Commissioner of Patents and Trademarks*